United States Patent [19]

Gilham

[11] Patent Number: 4,941,451

[45] Date of Patent: Jul. 17, 1990

[54] SOLID FUEL BURNING HEATER

[76] Inventor: Richard J. Gilham, 13 Swansea Road, Montrose, Victoria 3765, Australia

[21] Appl. No.: 404,677

[22] Filed: Sep. 8, 1989

[30] Foreign Application Priority Data

Sep. 19, 1988 [AU] Australia ..... PJ0502

[51] Int. Cl.[5] ..... F24C 1/14

[52] U.S. Cl. ..... 126/77; 126/290; 126/60; 126/112

[58] Field of Search ..... 126/61, 65, 77, 83, 126/200, 289, 290, 67; 76, 75, 120, 285; 110/214, 210; 237/50, 52

[56] References Cited

U.S. PATENT DOCUMENTS

| | | | |
|---|---|---|---|
| 4,287,871 | 9/1981 | Schumann et al. | 126/77 |
| 4,316,444 | 2/1982 | Gullickson | 126/83 |
| 4,361,131 | 11/1982 | Homolik | 126/77 |
| 4,643,165 | 2/1987 | Chamberlain | 126/77 |
| 4,665,889 | 5/1987 | Rumens et al. | 126/77 |
| 4,672,946 | 6/1987 | Craver | 126/83 |
| 4,766,876 | 8/1988 | Henry et al. | 126/77 |

*Primary Examiner*—James C. Yeung
*Attorney, Agent, or Firm*—Lorusso & Loud

[57] ABSTRACT

A heater for the burning of wood or other similar fuels in a fire box. The fire box has a door at the front, there being a primary air inlet to the fire box above the door. The fire box also has a secondary air inlet at the rear and a tertiary inlet at the top. The heater has a double skin so that all air for the secondary and tertiary inlets passes between the two skins so that it is pre-heated.

9 Claims, 4 Drawing Sheets

SOLID FUEL BURNING HEATER

This invention relates to heaters and refers particularly, though not exclusively, to heaters for the burning of combustible fuels such as, for example, wood and briquettes It is the principal object of the present invention to provide a heater whereby the combustion of the fuel is maximised, and the heat generated thereby is also used to the maximum extent.

With the above and other objects in mind, the present invention provides a heater having a fire box; said fire box having a front wall, a rear wall, two parallel side walls, a top and a base, a door in said front wall, a primary air inlet to said fire box above said door, a secondary air inlet to said fire box in said rear wall, and a tertiary air inlet to said fire box, said heater also having a second skin over said fire box so that air passes in a gap between said second skin and said fire box before passing through said secondary air inlet and said tertiary air inlet.

In order that the invention may be better understood there shall now be described a preferred construction of a heater incorporating the preferred features of the present invention, the description being by way of non-limitative example and with reference to the accompanying illustrative drawings. In the drawings.

Figure 1:
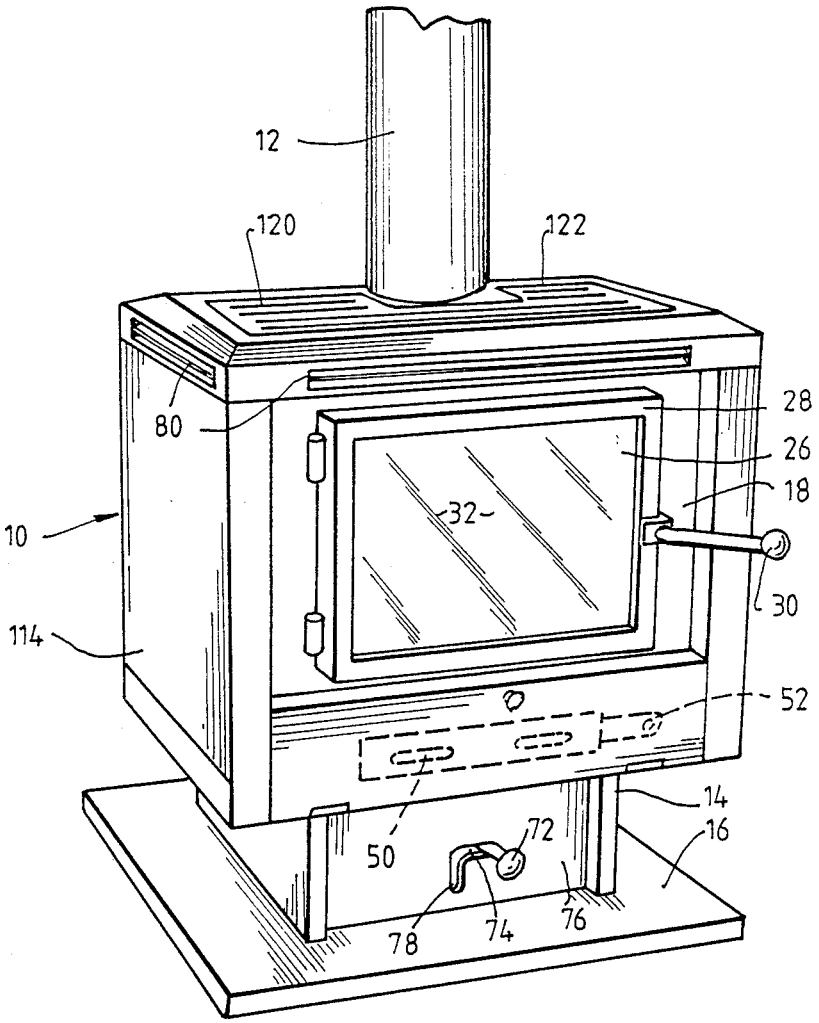
FIG. 1 is a front perspective view of the heater.

The heater illustrated comprises a heater 10, a chimney or flue 12, a pedestal 14 and a base 16.

The heater 10 is a cuboid and has a front 18, rear 20, and two sides 22. The front 18 has an opening 24 closable by a door 26. The door 26 has a peripheral frame 28 which has one side hingedly connected to the front 18 adjacent the opening 24, and the other side provided with a handle 30, which also allows the door 26 to be locked shut. A transparent panel 32 mounted in an insulating seal 34 completes the door 26.

The rear 20 and the two sides 22 of the heater 10, as well as part of the front 18 are made with a double skin. There is an interior skin generally designated as 36 which constitutes a fire box and a second skin 38 comprising the front 18, rear 20 and two sides 22. The fire box 36 has a top 40, a rear wall 42, sides 44, bottom 46 and front sections 48.

In front 18 below door 26 there are a plurality of openings 50 which have a slider control 52 so that the area of the openings 50 can be varied so as to control the rate of primary airflow into the heater 10. The air passes through the openings 50 and into the space between front 18 and the front 48 of the fire box 36. It passes up the space on either side of opening 24 to the space above the opening 24. There it can enter the fire box 36 through an access opening 54 immediately above and adjacent door 26. A deflector plate 56 deflects the air towards door 26. From the time the air enters openings 50 to the time it passes through the access opening 54 the air is continually heated by the front wall 48 of fire box 36. The air also helps to cool front 18.

As the air passes down the inside of panel 32 it heats further, also helping to cool panel 32. A lower deflector plate 58 deflects the air towards bottom 46 of fire box 36. There may be provided a grate 60 on bottom 46 and which holds the burning material. The air off the lower deflector plate 58 then passes through to and is consumed in the combustion of the material in the grate 60.

When most material burns, gases are given off. These gases are, in the main, combustible. However, there is normally no means for igniting these gases. To utilise the potential heat in these unburnt gases the present invention provides secondary and tertiary air induction so as to cause secondary and tertiary combustion.

Figure 2:
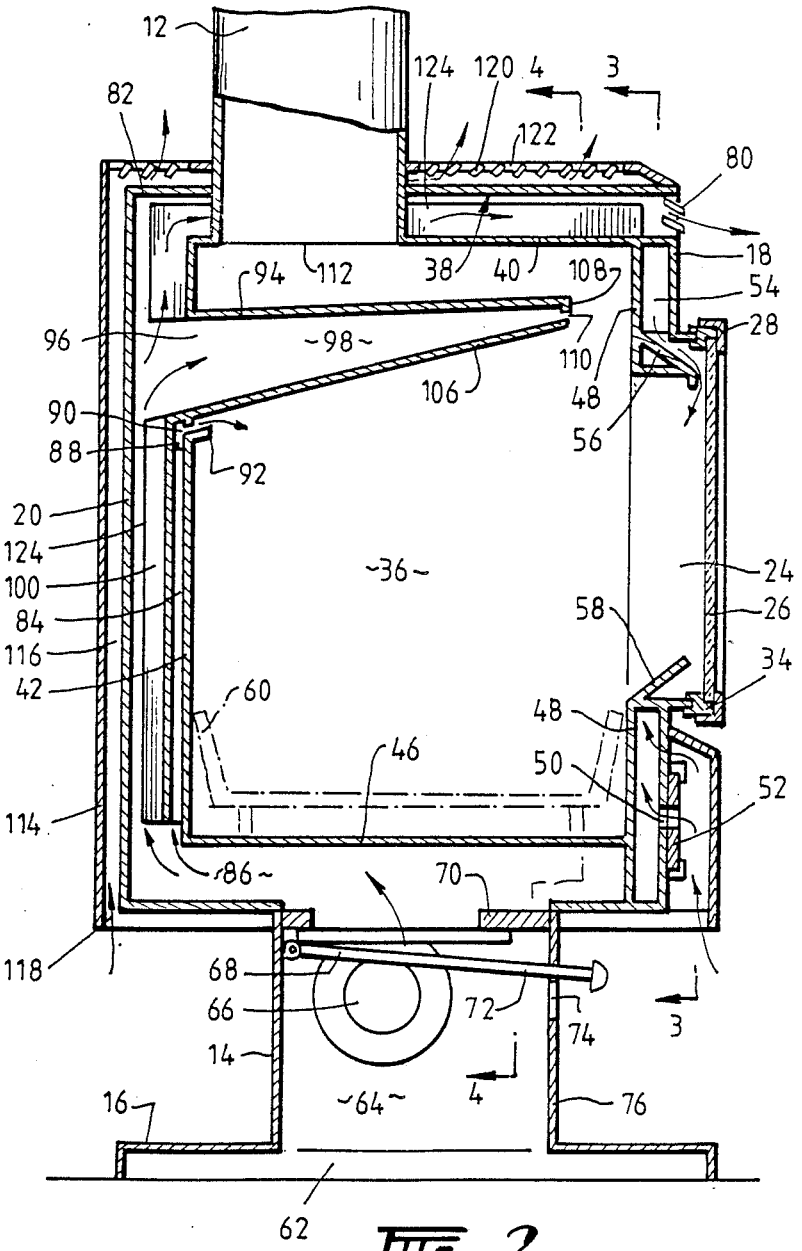
FIG. 2 is a vertical cross-sectional view along the longitudinal axis of the heater of FIG. 1.
Figure 3:
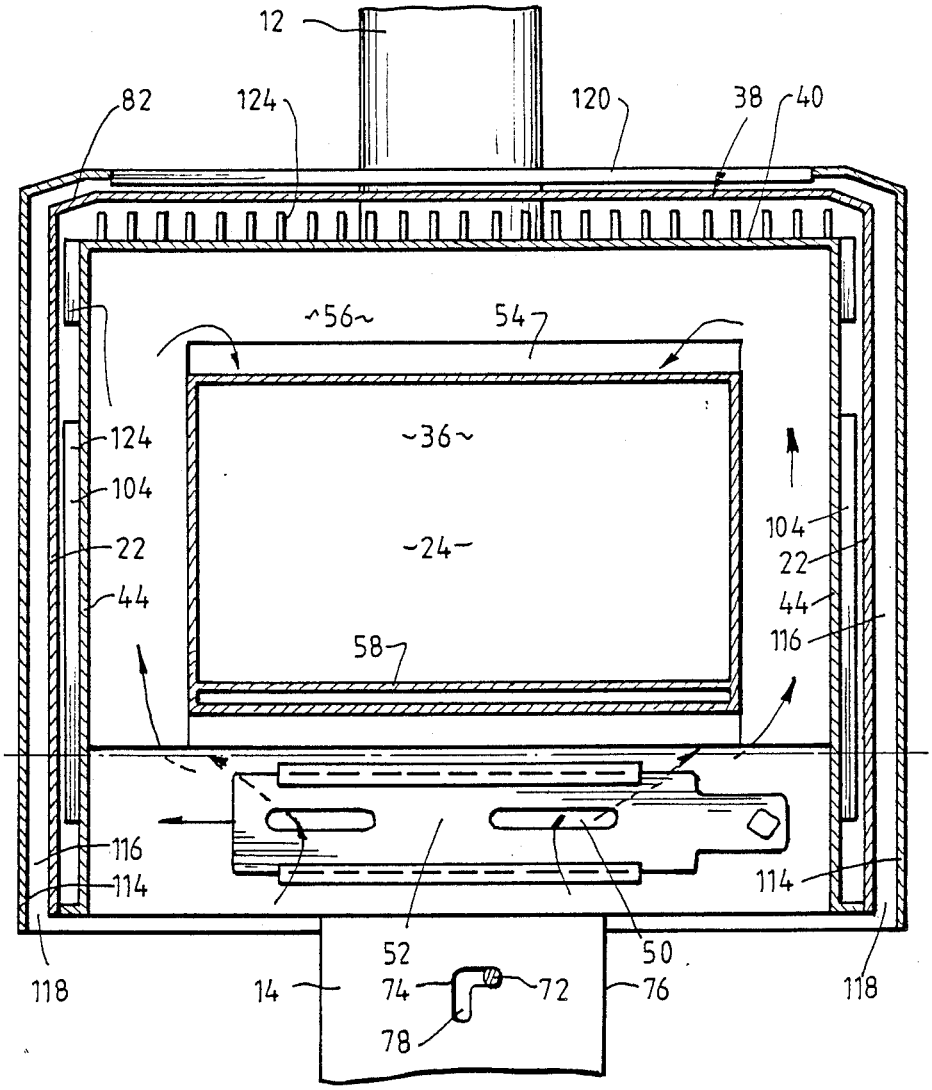
FIG. 3 is a full vertical cross-sectional view along the lines of and in the direction of arrows 3—3 of FIG. 2.
Figure 4:
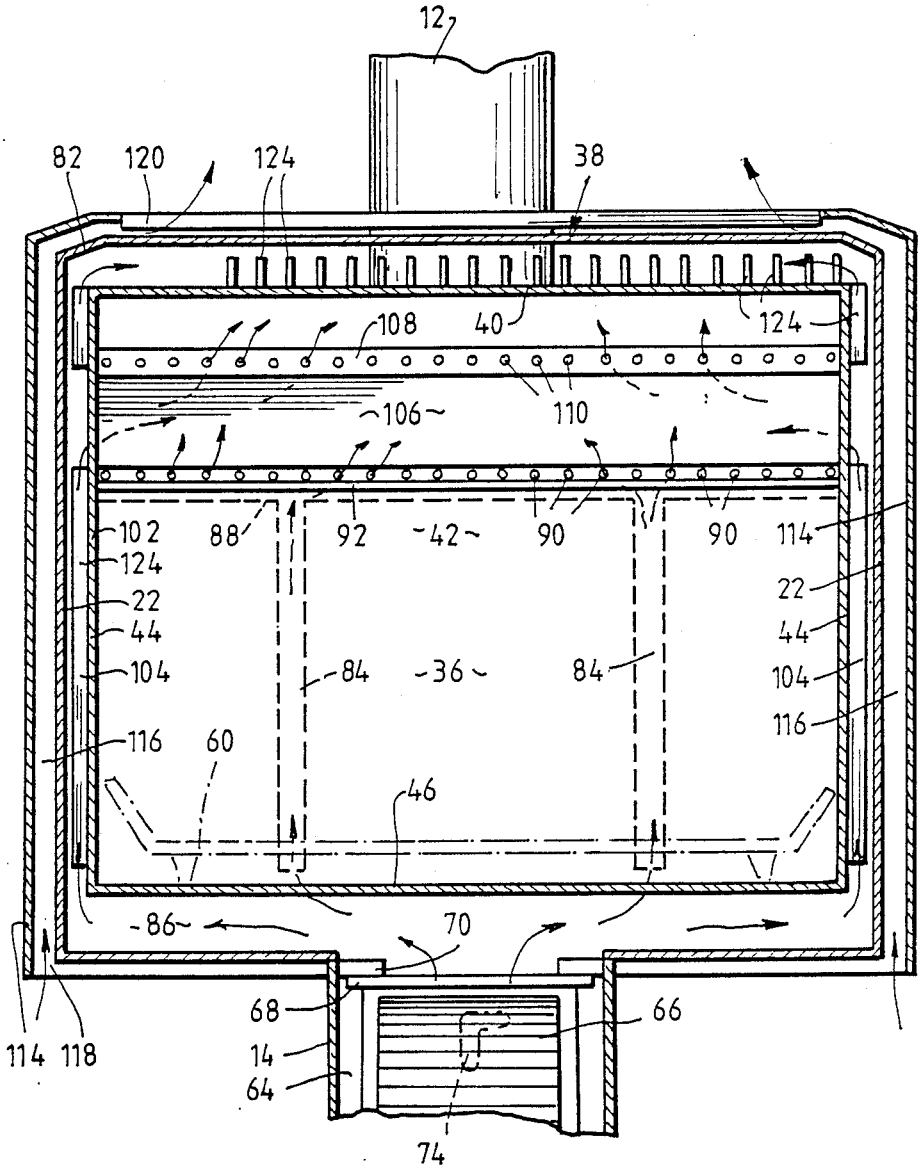
FIG. 4 is a full vertical cross-sectional view along the lines of and in the direction of arrows 4—4 of FIG. 2.

To do this, the base 16 has an opening 62 therethrough to allow air to enter the hollow interior 64 of pedestal 14. An electric fan 66 may be provided to assist in the air flow. The fan 66 is preferably mounted on a plate 68 hingedly connected to lower plate 70 at the rear thereof. The plate 68 is connected to a control rod 72 which passes through an L-shaped opening 74 in the front 76 of the pedestal 14. When the rod 72 is in the position shown in FIG. 1, the fan 66 is in the position shown in FIG. 2. However, if the rod 72 is moved to the lowermost point 78 of opening 74, the fan 66 is lowered so as to allow greater air flow due to natural convection.

The air passes into the space between lower plate 70 and the bottom 46 of the fire box 36. From there it can travel up the space between the sides 22 and the sides of fire box 36, all the time being heated. One possible course for the air is to travel to and pass over the top 40 fire box 36 and out through lowered openings 80 in front 18. This air has been heated and has also assisted in cooling the sides 22 and top 82 of heater 10.

Another route followed by the air entering through pedestal 14 is up between rear 20 and the rear wall 42 of fire box 36. This air would also be heated as it rises and would also pass over top 40 of fire box 36 and out through lowered openings 80, thus helping cool the rear 42 and top 82.

To allow for a secondary air inlet into fire box 36, two riser tubes 84 are provided and which allow air to enter through the lower space 86. As the air rises through the riser tubes 84 it is heated. The air then enters a secondary manifold 88 extending the full width of rear 42 of fire box 36. The manifold 88 has a plurality of openings 90 along its length. Heated air flows through the openings 90 into the fire box 36 to mix with the unburnt gases, thus providing the necessary oxygen input to allow the unburnt gases to ignite and burn. This increases the heat output of the heater 10. A secondary deflection plate 92 is provided to prevent the openings sooting-up, and to deflect the flow of unburnt gases past the air inlet stream.

There is also provided a hollow baffle 94 open at the rear 96 to enable air to enter the interior 98 of baffle 94 from the rear space 100. The baffle 94 is also open at each side 102 so that air can also enter the interior 98 of baffle 94 from the side space 104. The air entry helps to cool the baffle 94, particularly the lower plate 106. As baffles in fire boxes tend to have a short life-span, this flow of cooling air increases the life-span of the baffle 94.

The baffle 94 has a front 108 having a plurality of holes 110 therein. These holes 110 allow heated air to pass through in the manner shown in FIG. 2 to mix with anY unburnt gases to cause final or tertiary combustion.

This should complete the combustion of all unburnt gases, if the heater is operating effectively. The remaining gases and the smoke pass up through the flue 12 by means of a hole 112 in top 40.

Preferably, the openings 50 in front 18 are not all circular so that as the slider control 52 moves across the change in the area open is linear to provide for more accurate control. Also, this can allow proper balance of air flow so that it is not all through one side but evenly, to assist with an even burning.

Also, an outer skin 114 may be provided over the sides 22, rear 20 and top 82 so that contact by a person would not cause burning. The outer skin 114 is spaced from the sides 22, rear 20 and top 82 to allow an air gap 116. This air gap 116 is open at the bottom 118 to enable air to pass up through the gap 116 and out through lowered openings 120 in the top 122 of the outer skin 114. This air would be heated by rear 20, sides 22 and top 82, and would also keep the outer skin 114 cool.

The sides 44 and top 40 may be provided with air baffles 124 to control and direct the air flow so that an even air flow and heating of the air can result.

Whilst there has been described in the foregoing description a heater incorporating the preferred features of the present invention, it will be understood by those skilled in the technology concerned that many variations or modifications in details of design or construction may be made without departing from the present invention, the scope of which is to be determined from the foregoing description.

I claim:

1. A heater comprising:

a fire box, said fire box being formed by a front wall having a door, a rear wall having a plurality of openings, two parallel side walls connecting the front walla nd the rear wall, a base, and a top having an exhaust outlet, said fire box having a primary air inlet above said door, said primary air inlet directing air downwardly past said door;

a manifold connected to the plurality of openings in said rear wall to enable secondary air to be drawn into the fire box;

a skin over said fire box positioned to form a gap between the skin and the fire box to enable air to pass between the fire box and the skin, said skin having an opening below said door of said fire box to enable primary air to be drawn into the gap, said skin having an inlet opening beneath said base to enable secondary air to be drawn into said gap; and a baffle assembly extending inwardly from said rear wall above said plurality of openings and mounted between the side walls and intermediate between the top and the base, said baffle assembly formed from an upper baffle plate and a lower baffle plate defining a hollow interior, said baffle assembly being open at a rear end and side ends in communication with the gap between the fire box and the skin, said baffle assembly having a plurality of holes in communication with said fire box to allow tertiary air to pass from the gap through the baffle assembly into the fire box to enable tertiary air to mix with any unburnt gases in the fire box to cause final or tertiary combustion.

2. A heater as claimed in claim 1 wherein the front of the fire box has at least one opening to enable air not required for primary, secondary or tertiary air inlets to pass over the sides, back and top of the fire box and out the opening to cool the fire box and provide improved heat extraction.

3. A heater as claimed in claim 1, wherein the front of said skin has adjustable openings therethrough to enable air to pass through said gap and said primary air inlet, said front of said fire box having a first deflector plate on the inner surface thereof above said primary air inlet to direct the air over said door.

4. A heater as claimed in claim 3, wherein said front of said fire box has a second deflector plate on the inner surface thereof below said door to deflect the air towards the fire in the fire box.

5. A heater as claimed in claim 1, wherein the base of said skin has openings therethrough adjacent said rear wall of said fire box to enable air to enter at least one riser tube, said riser tube being operatively connected to said manifold.

6. A heater as claimed in claim 5, wherein the interior of said rear wall has a secondary deflection plate below said plurality of openings in said rear wall.

7. A heater as claimed in claim 1, wherein the top of said skin has at least one opening therethrough to enable air not required for said primary, secondary or tertiary air inlets to pass therethrough.

8. A heater as claimed in claim 7, wherein the outer surfaces of said side walls and said top are provided with air baffles to control and direct air flow and to provide greater heat transfer.

9. A heater as claimed in claim 1, wherein there is provided an outer skin over the sides, rear and top of said skin, said outer skin being spaced from said skin by a further air gap, said air gap being open at the bottom of the sides and rear of said outer skin to enable air to enter therethrough and to pass through said further air gap the top of said outer skin having openings therethrough to enable air to pass therethrough.

* * * * *